US010011981B2

(12) United States Patent
Sica

(10) Patent No.: US 10,011,981 B2
(45) Date of Patent: Jul. 3, 2018

(54) PRE-DISTANCING COLLAPSIBLE SYSTEM PARTICULARLY FOR THE ELEMENTS OF A STRUCTURAL FRAME

(71) Applicant: Mauro Sica, Novara (IT)

(72) Inventor: Mauro Sica, San Francisco, CA (US)

(73) Assignee: PRE-FRAMING CORP., San Francisco, CA (US)

( * ) Notice: Subject to any disclaimer, the term of this patent is extended or adjusted under 35 U.S.C. 154(b) by 0 days.

(21) Appl. No.: 14/893,398

(22) PCT Filed: Jun. 3, 2014

(86) PCT No.: PCT/EP2014/061444

§ 371 (c)(1),
(2) Date: Nov. 23, 2015

(87) PCT Pub. No.: WO2014/195289

PCT Pub. Date: Dec. 11, 2014

(65) Prior Publication Data

US 2016/0090732 A1 Mar. 31, 2016

(30) Foreign Application Priority Data

Jun. 3, 2013 (IT) ..... NO2013A0004

(51) Int. Cl.
*E04B 1/343* (2006.01)
*E04B 2/56* (2006.01)
(Continued)

(52) U.S. Cl.
CPC ..... *E04B 1/34357* (2013.01); *E04B 2/56* (2013.01); *E04C 2/386* (2013.01); *E04B 1/3441* (2013.01);
(Continued)

(58) Field of Classification Search
CPC ..... E04B 1/34357; E04B 2/56; E04B 2001/34389; E04B 2/707; E04B 1/3441; E04C 2/386
See application file for complete search history.

(56) References Cited

U.S. PATENT DOCUMENTS 907,032 A * 12/1908 Gohen ..... A47B 43/04 135/151
1,448,539 A * 3/1923 Hopwood ..... A47F 7/146 108/149
(Continued)

FOREIGN PATENT DOCUMENTS

FR 2551788 A1 3/1985
JP 2010112134 5/2010

OTHER PUBLICATIONS

International Search Report based on International Application No. PCT/EP2014/061444, dated Aug. 6, 2014 (4 pages).
(Continued)

*Primary Examiner* — Phi D A
*Assistant Examiner* — Omar F Hijaz

(57) ABSTRACT

The present invention refers to a pre-distancing collapsible system particularly for the elements of a structural frame of a building. An embodiment of the invention comprises at least three components of a structural frame and at least two spacers, not being these spacers structural elements of the frame, fastened to the heads of aforementioned components of the frame, and said spacer being foldable.

18 Claims, 3 Drawing Sheets

(51) Int. Cl.
*E04C 2/38* (2006.01)
*E04B 2/70* (2006.01)
*E04B 1/344* (2006.01)

(52) U.S. Cl.
CPC ..... *E04B 2/707* (2013.01); *E04B 2001/34389* (2013.01)

(56) References Cited

U.S. PATENT DOCUMENTS 2,036,363 A * 4/1936 Schaefer ..... B65D 90/024 52/223.3
2,880,470 A * 4/1959 Pickersgill ..... E04B 2/16 446/127
3,025,970 A * 3/1962 Ostrom ..... A47B 43/006 108/96
3,206,903 A * 9/1965 Johnson ..... E04B 1/26 52/276
4,884,659 A * 12/1989 Chao ..... E06C 5/30 182/164
5,012,590 A * 5/1991 Wagner ..... B25H 7/00 33/494
5,161,345 A * 11/1992 Sobjack, Sr. ..... E04B 7/022 33/613
6,115,984 A * 9/2000 Paradis ..... E04C 3/005 52/247
7,028,446 B2 * 4/2006 Winchester ..... E04B 5/12 52/105
7,181,887 B1 * 2/2007 Baij ..... E04G 21/1891 52/105
7,739,850 B2 * 6/2010 Daudet ..... E04B 1/24 52/210
8,225,521 B1 * 7/2012 Mooney ..... E04G 21/1891 33/194
2002/0095906 A1 * 7/2002 Edmondson ..... E04F 21/0015 52/745.05

OTHER PUBLICATIONS

Japanese Office Action "Notice of Reasons for Refusal" issued by JPTO dated Apr. 3, 2018 for corresponding Japanese application No. 2016-516201 and English Summary of the same.

* cited by examiner

PRE-DISTANCING COLLAPSIBLE SYSTEM PARTICULARLY FOR THE ELEMENTS OF A STRUCTURAL FRAME

CROSS-REFERENCE TO RELATED APPLICATIONS

This application is a 371 of PCT/EP2014/061444, filed Jun. 3, 2014, which claims the benefit of Italian Patent Application No. NO2013A000004, filed Jun. 3, 2013.

FIELD OF THE INVENTION

The invention relates to a prefabrication system for the structural components of a partially pre-assembled frame, in wood or other material, in particular for the construction of interior and exterior walls, floors, roof trusses and roofs of buildings.

BACKGROUND

The typical platform framing technique, which is also the most common light framing construction technique (in USA, Canada, Australia, UK) requires the interpretation of blueprints, often designed using a CAD software, and the selection, measurement, marking, cut and assembly of many components, (as studs) that need to be spaced at specific distances. All the work is made on the construction site where weather may impede construction.

This phase requires the presence on site of highly qualified personnel, it is the most complex and it is subject to errors caused by incorrect interpretation of the drawings or by human error in the marking process or cutting of the components. Moreover, after having correctly positioned the various components to the ground, components as studs typically are repositioned elsewhere for cutting and then placed back in position, an operation which requires additional time.

There are alternatives to traditional platform framing on-site construction.

The most known and used is the off-site prefabrication of entire walls or sections of walls, floors, and trusses, which are then transported to the construction site.

Another system, typically used for kit-homes, requires to process every single stud, plate, joist or other components one at a time, cutting and marking them, then packing and shipping all to the construction site.

Other less known patented systems require the prefabrication of collapsible light metal frames which are then opened and installed on-site, where the vertical components are hinged with the horizontal components. Sometimes even the studs are collapsible (example U.S. Pat. No. 6,318,044 B1).

The pre-prefabrication in a factory of complete walls and floors (framework and sheathing) are well known and generally used when there is the need to build on a very short timeframe, on remote sites or with adverse climate. In those cases these system is competitive compared to the traditional platform framing on-site construction but usually they are not very cost-effective and therefore less used.

For the prefabrication of entire walls and ceiling usually the money saved thanks to the use of better systems within the factory and thanks to a faster installation on-site is often compensated by the fixed costs of the facility where the walls are manufactured, the cost of the equipment used, which is not fully automated, therefore it still requires extensive use of labor in the factory, and transportation costs, much higher than the simple transportation of the lumber needed for traditional on-site construction (which take up only about 25% of prefabricated walls and floors volume during transportation). Furthermore there is the cost of temporary indoor storage space for finished walls and sometimes the crane cost for the installation on-site.

In addition most of the times contractors does not own the factory, for the manufacturing of walls and floors, and the crane needed for the installation on-site, so they need to pay third-party suppliers, reducing their profit.

About kit-houses, with all the elements pre-cut in an off-site facility, the transportation cost is not substantially different, but the costs are increased by the need to cut, number, mark and make a schedule of all the components, one by one, and by the fact that on the construction site somebody need to interpret the drawings and the schedule of all the singular components and then find them. This can be quite complex and time consuming, making this system usually not competitive compared to the traditional on-site marking & cutting of the components, especially for the construction of a single home.

About the patented collapsible light frames hitherto known, if they are in production they are really little used. Probably the drawback of this systems can be the high production cost, due to a higher number of industrial processes required, the greater amount of material required and the transportation cost, more competitive compared to other known types but still greater than the transportation cost of the individual, not yet assembled, components. Moreover, often this systems work only for light gauge metal frames, still far less used than wood.

SUMMARY OF THE INVENTION

Purpose of the present invention is to provide a prefabrication system that allows the production of inexpensive, high precision, structural frames made out of wood, metal or other materials, a simple and quick installation on site, eliminating completely the manual measuring, marking & cutting operations usually necessary on-site and the need to use a crane for the installation.

Further, the other purpose of the present invention is to keep transportation cost as low as for traditional construction on-site, with the shipped material occupying the same volume.

Further, the other purpose of the present invention is to eliminate the need to mark one by one and then schedule all the single pre-cut components in the off-site facility and to have the chance to make the few cuts required without moving or repositioning any component as the studs, so saving time.

Further, the other purpose of the present invention is to make the production of these frames, which are in fact different one from another, way more efficient, using a fully, or almost fully automated machine, with minimum use of labor, not even necessarily skilled.

Furthermore, the other purpose of the present invention is the use of low-cost machinery and a relatively small facility for the manufacturing.

These and other purposes are achieved by the pre-distancing collapsible system according to the invention characterized in that it comprises at least three components of a structural frame and at least two spacers, being said spacers, not part of the supporting structure of the frame, integral with the head of those frame components, and being said spacers foldable.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of example embodiments of the invention, and are not restrictive of the invention, as claimed.

DETAILED DESCRIPTION OF THE INVENTION

Figure 1:
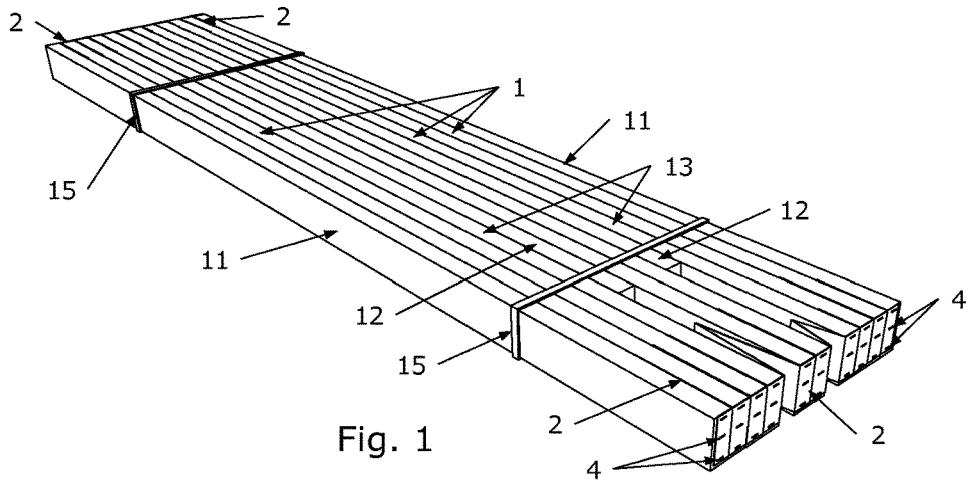
FIG. 1 is a perspective view of the structural wooden vertical components (or studs) with the spacers fastened on the heads of the studs of a wall frame example with a window opening in the middle, packed with strips and ready for storage and transportation.
Figure 2:
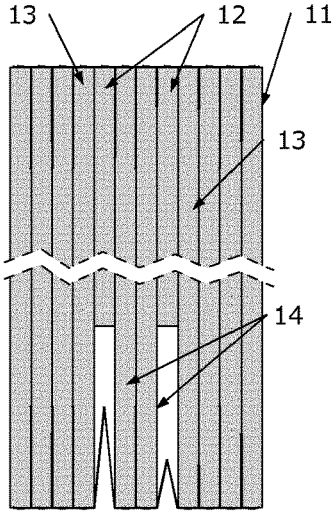
FIG. 2 is a top plan view of the same components in FIG. 1, without strips and ready to be unfolded, in which the central part is not shown for the sake of drawing simplicity.
Figure 3:
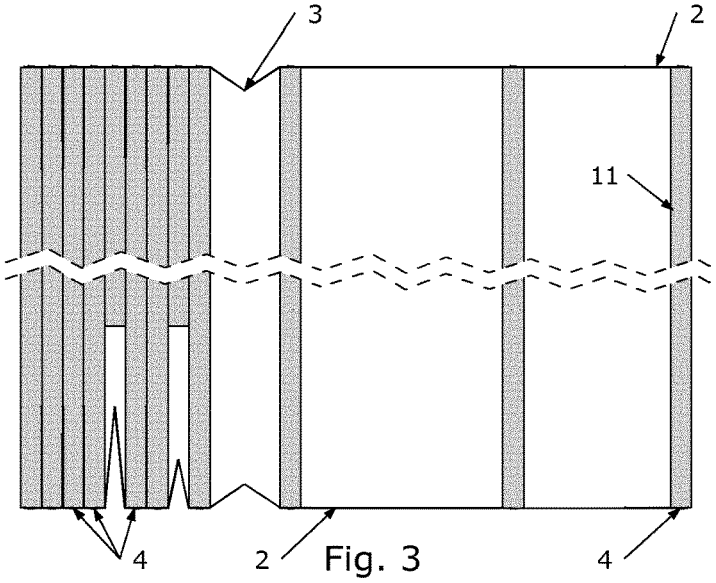
FIG. 3 is a top plan view of the same components of FIG. 1 during the opening, in which the central part is not shown for the sake of drawing simplicity.
Figure 4:
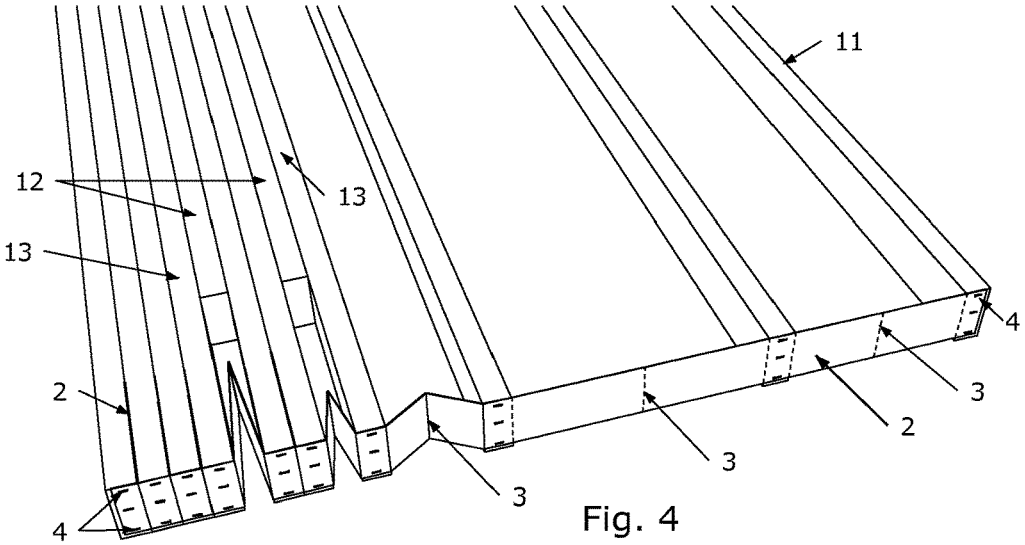
FIG. 4 is a perspective view of the same components of FIG. 1 during the unfolding process. The frame is lying in a horizontal position, as usual in light-frame construction prior to wall erection.

The system, as illustrated in the drawings, comprises the structural vertical components of the wood frame 1, also called studs, of a wall with a window opening in the middle. The spacers 2 are fastened to each head of the studs by staples or nails 4. The spacers are made of foldable material (e.g. aluminum sheet 2/10 mm thick) and the length of the portion of foldable material between one stud and the other depends on the distance designed for the frame. The spacers are folded between a stud and the other during storage and transportation as shown in FIG. 1, where a wall is packed with strips 15, ready for transportation. The two studs 12 are shorter compared to the others, they are the so called "jack studs", supporting the window header 10. The two jack studs 12 are fastened to the adjacent full-height studs 13, the so called "king studs".

Figure 5:
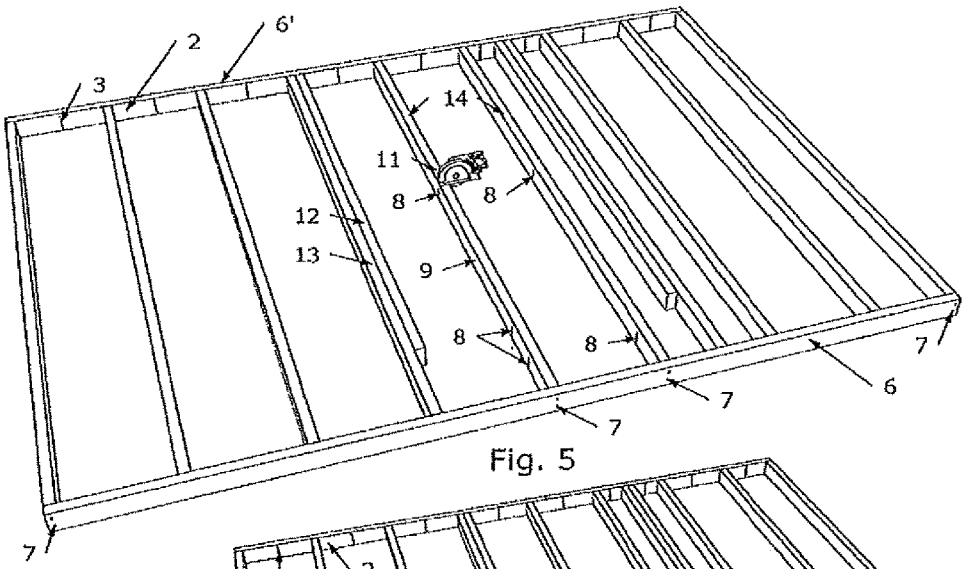
FIG. 5 is a perspective view of the frame completely unfolded, with its spacers fully unfolded at the maximum extension and the two horizontal components, the top and bottom plates, already end-nailed to the vertical components (studs) and to the two partially-cut studs that still require to be completely cut. The frame is lying in a horizontal position.

In FIG. 5 are also visible the partial cuts 8 in the two studs 14, and the two horizontal components of the frame 6 and 6' (called top and bottom plates) assembled in final position, which could also be pre-marked for simplicity. The horizontal components of the frame, the so called top and the bottom plates, are end-nailed to the studs by the nails 7.

Figure 6:
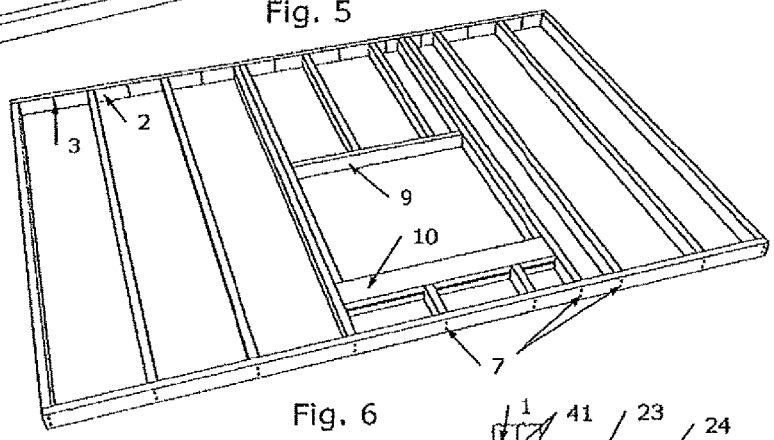
FIG. 6 is a perspective view of the frame completely assembled with all the studs completely cut and with the window sill and window header also assembled. The frame is still lying in a horizontal position.
Figure 7:
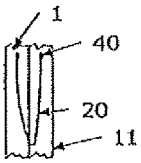
FIG. 7 is a top plan view of a variant in which the spacers are wires or cables. The view shows part of two studs, the ends are not shown for the sake of drawing simplicity, and a spacer, packed together for transportation.
Figure 8:
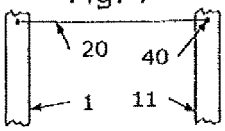
FIG. 8 is a top plant view of the variant of FIG. 7 where the two studs are unfolded.

Referring to FIG. 6, the window sill 9 is assembled in final position, being the sill 9 a section of one of the two studs 14, still not cut in FIG. 5. FIG. 6 shows also the window header 10 assembled in the final position. The frame is lying in a horizontal position, as usual in light-frame construction prior to wall erection.

FIGS. 7 to 18 show several technically equivalent embodiments, not preferred for various reasons. In these figures the spacers are fastened to the side of the studs, except in FIG. 15 where one of the spacers can be also fastened to the head, as in the preferred embodiment.

Figure 9:
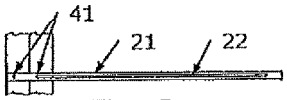
FIG. 9 is a top plan view of a variant in which the spacers are rigid bodies with a sliding slot. The view shows two studs, the ends are not shown for the sake of drawing simplicity, and a spacer, packed together for transportation.
Figure 10:
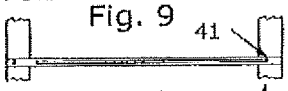
FIG. 10 is a top plant of the variant of FIG. 9 where the two studs are unfolded.
Figure 11:
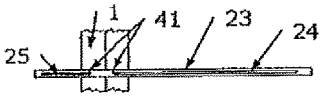
FIG. 11 is a top plan view of a variant in which the spacers are rigid bodies with two sliding slots. The view shows two studs, the ends are not shown for the sake of drawing simplicity, and a spacer, packed together for transportation.
Figure 12:
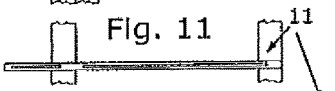
FIG. 12 is a top plan view of the variant of FIG. 11 partially unfolded.
Figure 13:
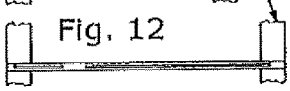
FIG. 13 is a top plan view of the variant of FIG. 11 where the two studs are unfolded.

Instead of the spacer made out of a sheet other types could be used, such as wires 20 (FIGS. 7 and 8) fastened to the studs with staples, nails or pins 40, otherwise narrow belts, strips or straps could be used too. Another technically equivalent spacer is a rigid type 21 with a sliding slot 22, which allows the fastening means (e.g. staples, nails or screws 41) to run in the range of the sliding slot (FIGS. 9 and 10). A variant of this rigid spacer is a spacer 23 with two sliding slots 24 and 25 where the means 41 can run, as shown in FIGS. 11, 12 and 13, in positions of progressive unfolding. This variation is useful to reduce the size of the spacers, particularly for small wall frames.

Figure 14:
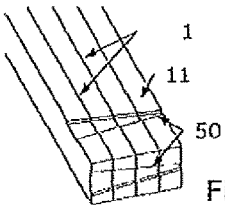
FIG. 14 is a perspective view of a variant in which the spacers are rigid and are not fastened to the frame components. The frame components have grooves of different widths cut into the surface. The view shows five studs, one end is not shown for the sake of drawing simplicity, and no spacers, packed together for transportation.
Figure 15:
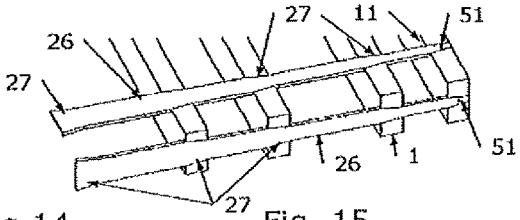
FIG. 15 is a perspective view of the variant of FIG. 14 with the five studs and two spacers in place for the unfolding, where the studs are shown in partially unfolded configuration.
Figure 18:
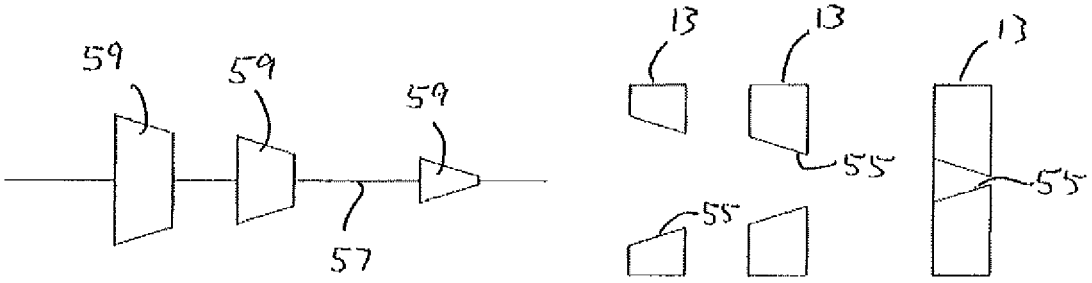
FIG. 18 shows an embodiment with spacers consisting of a wire with small rigid elements of increasing dimension fastened to it.

FIGS. 14 and 15 show a further variant, respectively in packed configuration for transportation and unfolded. In this case the rigid spacers 26 are not fastened in the factory to the studs. The spacers 26 are cut (for example by laser, plasma or water) to be shaped with progressively increasing width 27. On the head or, in alternative, on the sides of the studs a groove of variable width 50 is cut into the upper surface of the studs, then the studs are packed and shipped. The components of the frame 1 are placed on a horizontal surface in the construction site, then (FIG. 15) a worker need to fasten the spacer to the stud 11, driving a nail or a screw 51 throughout the spacer 26 to the first stud 11. So, the rigid spacer 26, and the stud 11 will be dragged together during the unfolding and each time the width of the spacer 26 will match with the grooves cut into the studs, in the points 27, being the groove and the spacer of the same width, a stud will unfold in final position, according to the frame design. Instead of cutting a groove and a plate shaped spacer, a variant could also be each spacer having a drilled hole, with the diameter of the holes becoming progressively higher, throughout all the studs, with a spacer of variable diameter able to match with the holes. This spacer may be rigid, or consisting of a wire with small rigid elements of growing section fastened to it, like a "string of pearls", with "pearls" of increasing diameter. FIG. 18 shows the "string of pearls" embodiment, in particular wire 57, i.e. the string, and rigid elements 59, i.e. the pearls, of increasing diameter. FIG. 18 also shows holes 55 of progressively higher diameter, formed in studs 13.

In all cases, all these types of spacers need to be positioned on the studs properly, on the head or on the sides, in order to keep parallel all the studs during the unfolding, as the preferred type illustrated above does. So if the spacers are fastened to the side and not on the head of the studs, it is necessary to provide the same spacers on both sides of the studs.

In alternative to partially-cut the studs 14 it would be possible to completely cut the studs 14 in the factory, but additional spacers are going to be needed to maintain parallel the cripple studs (the completely cut studs) during the unfolding, because the free end of the cripples could otherwise be free to move uncontrolled during the unfolding operation.

Another alternative, instead of cut partially the studs 14, could be pre-assemble completely the window opening (or the door opening) in the factory, complete with sill and header. So we can have one or more sections of studs with the collapsible spacers fastened and one ore more sections completely prefabricated, preferably the sections with openings.

This is going to be a much bigger frame to transport but could be faster to unfold on site.

The spacers may be made out of the most disparate materials, as fabrics, plastics, cardboard, metals. The aluminum has been preferred for its mechanical strength, the characteristic of being rustproof, fireproof and not sharp-edged at low thickness, but also to be easily foldable and easy to drill or punched if needed.

Figure 16:
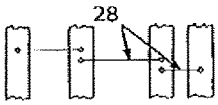
FIG. 16 is a top plan view of the a variant scheme with discontinuous spacers in a series that connect couples of studs together.

FIG. 16 shows a configuration scheme of the spacers 28 configured differently, fragmented in a series of smaller spacers rather that a continuous one, not preferred but technically equivalent.

Figure 17:
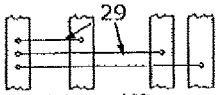
FIG. 17 is a top plan view of the variant scheme with the spacers connected in a parallel configuration, with the first stud connected with all the others.

FIG. 17 shows another configuration scheme, equivalent but not preferred, where the spacers 29 are connected to the studs in a parallel configuration, with the first or the last stud connected with a spacer to all the others.

The operating principle of the system according to the invention is as follows: Every wall frame need to be designed (or drawn) on a CAD system, which can run on PCs, tablets and smartphones. The file is then sent to a small, cost-effective, automated CNC machine inside the manufacturing facility, which very efficiently and without errors, in a weather-protected environment, assemble every packed wall frame (FIG. 1), as the example shown in FIG. 1 to FIG. 6. The manufacturing process operates as follows:

Whenever a wall opening occurs in the design, the studs 12 are trimmed (jack studs) and the studs 14 are also cut 8, but incompletely. Then the trimmed jack studs 12 are fastened to the adjacent full-height studs 13, called king studs (e.g. by screws, nails, staples, glue)

Next step (although this could be done at the same time of the above-listed operations) is to fasten the spacers 2 to the stud heads, using, for example, staples 4.

The spacers in the preferred embodiment are metal strips and are not going to be part of the final structure of the frame. These spacers 2 are fastened to the heads of all the studs (1,11,12, 13 and 14) so that the portion of the metal strip between a stud and the next one matches with the distance designed between this two studs once the frame is unfolded. The spacer 2 is preferably folded (and pushed) towards the inner part of the frame structure, along the middle 3 of the portion between two studs, so that during storage and transportation the spacers stay protected. The folding and fastening operations are repeated for each stud, on both heads.

All this can be manufactured on a cost-effective equipment which could also be quite small in alternative to the traditional off-site assembly of the frame, usually not fully automated and made on a huge stud framing table. In fact all the aforementioned operations require to space only two or three studs at a time, even just slightly, cut (8) the studs, fasten the spacers 2 put the two studs next to each other again, and proceed to the two/three following studs, Also, if required, the flexibility of the spacers 2 allows to fold and push them between one stud and the other avoiding a complete spacing.

The thickness of the strip 2 could be less then 2/10 mm, so the thickness of the folded strip between the studs, about 4/10 mm, it is irrelevant for the packaging and does not increase the volume during transportation compared to standard lumber, and consequently the transportation cost. The whole operation can be performed with CNC machines, without errors and very quickly, with minimal or no assistance of an operator. The studs of each wall frame are then packed and shipped.

Once the wall frame of the example arrives on site it can preferably be placed in a horizontal position, the strips 15 are removed, then dragging one of the outer studs 11, or both external outer studs 11 at the same time if two workers are available, the wall frame is unfolded. In a few seconds all the studs will be at the designed distance automatically, the spacers 2 will unfold completely along the folds 3 during the operation as showed in FIG. 4. The studs 13 and 12, fastened together off-site, will be dragged together, being a single part.

Referring to FIG. 5 the structural horizontal components 6 and 6' (top and bottom plate) are now placed in final position and it is possible to proceed to end nail, by nails 7, both the two studs 11 to the top and bottom plates 6 and 6', making sure all is squared properly. Automatically the rest of the studs will stay still and squared, greatly speeding up the nailing of the rest of the frame.

Some of the studs 14 are partially pre-cut. The cuts 8 are deep enough to easily complete the cut but not deep enough to compromise the structural integrity of the studs 14 during transportation, and are intended to be placed on the bottom, from the floor up, during the unfolding process.

Once the studs are all end nailed to the top and bottom plates 6 and 6' it will be time to cut the studs 14, so preventing every movement of the members. The cuts 8 provide a rail and a marking to easily complete the cut that can be quickly executed using any low-cost tool, such as a circular saw 11, with no need to move anything.

The usual operations of measurement, marking, repositioning, cutting and finally repositioning back in place are no longer necessary with this system.

The trimmed member 9 in the example (FIG. 5) will become the window sill, as shown assembled in FIG. 6. The scrap after the cutting is minimal, and could be used for double the sill 9 as some framers do, or used as fire-blocks, between a stud and the other.

The window header 10 is now nailed in position and the wall frame is completed, ready for the traditional next steps, as sheeting and raising.

The spacers 2, which are not structural, once the frame is unfolded could be easily removed, but the operation is not necessary because they do not disturb any of the next steps of the construction. In case they can be easily cut and removed.

This system is even more advantageous with gable walls, where the studs length is variable and the cuts are inclined.

The invention eliminates completely both the manual measuring, marking & cutting operations subject to errors usually necessary on-site and the need to use a crane for the installation of prefabricated frames. This system does not increase the cost of transportation. In addition, the installation is so simple that a few hours training for the crew is enough. All this allows to a error-proof, fast and very cost-effective frame construction thanks to a low-cost automatization and the negligible cost of the aluminum strips and staples.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

The invention claimed is:

1. A pre-distancing wall frame system comprising a plurality of structural components that include stud components, sills and headers, and nonstructural components including at least two spacers, said spacers coupled to outwardly facing end surfaces of longitudinal ends of said stud components and each said spacer including a fold between adjacent ones of said longitudinal ends of said stud components when said wall frame system is in a collapsed state, wherein said plurality of said structural components form part of a wall frame that includes a window or door opening with said sills and headers when said wall frame system is in an uncollapsed state, and wherein said spacers are each unfolded and have an unfolded maximum length without said fold that defines a distance between said stud components, when said wall frame system is in said uncollapsed state, and wherein some of said structural components include partial cuts spaced apart by a distance that defines a length of a further structural component disposed within and removable from said structural component.

2. The pre-distancing wall frame system of claim 1, wherein said at least two spacers include spacers with different said unfolded maximum lengths between said adjacent ones of said longitudinal ends of said stud components when unfolded, such that when said spacers are unfolded and said system is in said uncollapsed state, at least some adjacent ones of said stud components are separated by different distances.

3. The pre-distancing wall frame system of claim 1, wherein said stud components have different lengths, wherein shorter ones of said stud components are adapted to support said sills or said headers when said collapsible system is in said uncollapsed state.

4. The pre-distancing wall frame system of claim 1, wherein said longitudinal ends of said stud components are adapted to be joined to top and bottom further structural components to form said wall frame in an assembled state.

5. The pre-distancing wall frame system of claim 1 wherein said spacers each comprise a strip having a thickness of 0.2 mm.

6. The pre-distancing wall frame system of claim 1 wherein said plurality of said stud components include an opposed plurality of said longitudinal ends, and wherein a first spacer of said at least two spacers is coupled to said outwardly facing end surfaces of one of said plurality of said longitudinal ends and a second spacer of said at least two spacers is coupled to said outwardly facing end surfaces of the other of said opposed plurality of said longitudinal ends.

7. The pre-distancing wall frame system of claim 1 wherein said spacers each comprise an aluminum strip.

8. The pre-distancing wall frame system of claim 1, further comprising top and bottom horizontal structural components and wherein said longitudinal ends of said stud components are joined to said top and bottom horizontal structural components to form said wall frame, wherein said spacers are disposed between said top and bottom horizontal structural components, and said longitudinal ends.

9. The pre-distancing wall frame system of claim 1 wherein said at least one sill or header is disposed between partial cuts formed within at least one of said structural components.

10. The pre-distancing wall frame system of claim 1 wherein, when said wall frame system is in said collapsed state, adjacent ones of said structural components are in contact with one another.

11. The pre-distancing wall frame system of claim 1 wherein, when said wall frame system is in said uncollapsed state, said spacers are straight and continuous and form right angles with said stud components.

12. A pre-distancing system comprising a plurality of stud components of a structural frame and non-structural components including at least two spacers, said spacers fastened to outwardly facing end surfaces of longitudinal ends of at least three said stud components of said structural frame and said spacers including a fold between two said stud components when said pre-distancing system is in a collapsed state and wherein said spacers are unfolded, do not have said fold and include an unfolded maximum length that defines a distance between said stud components when said structural frame is in an uncollapsed state, wherein said stud components of said structural frame are configured to form a wall frame that includes a window or door opening with sills and headers when said pre-distancing system is assembled and wherein at least a first stud component of said plurality of stud components includes at least a further structural component therein, said further structural component having a length defined by spaced apart partial cuts disposed on said first stud component, each said further structural component comprising one of said sills or one of said headers or a base stud component adapted to be attached to said at least one of said sills and headers.

13. The pre-distancing system of claim 12, wherein each said spacer comprises an aluminum strip.

14. The pre-distancing system as in claim 12, wherein said at least two spacers includes spacers with different said unfolded maximum lengths such that when said structural frame is assembled, at least some adjacent ones of said stud components are separated by different distances.

15. The pre-distancing system as in claim 12, wherein said stud components of said structural frame include different lengths, said further structural component comprises said header, and a shorter one of said stud components supports said header when said structural frame is in an assembled condition.

16. A wall frame assembly comprising:

a plurality of structural components including wall studs, and nonstructural components including at least two spacers, said spacers coupled to outwardly facing end surfaces of each of opposed longitudinal ends of said structural components, each said spacer being flexible and including a fold between adjacent ones of said longitudinal ends of said structural components when said wall frame assembly is in a collapsed state, and wherein said wall studs form part of a wall frame and at least a first structural component of said plurality of structural components includes partial cuts at locations that define a further structural component disposed within and forming part of said first structural component, and wherein said further structural component comprises a sill or header.

17. The wall frame assembly of claim 16 wherein said wall studs are spaced apart by maximum unfolded lengths of said spacers when said spacers are unfolded and include no folds, when said wall frame assembly is in an uncollapsed state.

18. The wall frame assembly of claim 16, wherein said further structural component comprises a header, said wall studs include different lengths and wherein a shorter one of said wall studs supports said header when said wall frame assembly is in an assembled condition.

* * * * *